US005376765A

United States Patent [19]

Holmes et al.

[11] Patent Number: 5,376,765

[45] Date of Patent: Dec. 27, 1994

[54] KEY LEVELER APPARATUS

[75] Inventors: Kirk R. Holmes, Las Cruces, N. Mex.; Nurmi G. Ingram, El Paso, Tex.

[73] Assignee: Key Tronic Corporation, Spokane, Wash.

[21] Appl. No.: 194,111

[22] Filed: Feb. 8, 1994

Related U.S. Application Data

[63] Continuation of Ser. No. 945,772, Sep. 16, 1992, abandoned.

[51] Int. Cl.[5] ..... H01H 13/70

[52] U.S. Cl. ..... 200/344; 200/345; 200/517

[58] Field of Search ..... 200/344, 345, 341, 327, 200/517; 400/496, 490

[56] References Cited

U.S. PATENT DOCUMENTS

| | | | |
|---|---|---|---|
| 4,384,796 | 5/1983 | Derley | 200/344 X |
| 4,392,037 | 7/1983 | Fleming | 200/344 |
| 4,453,063 | 6/1984 | Wanatowicz et al. | 200/344 |
| 4,709,128 | 11/1987 | Odagawa | 200/344 |
| 4,771,146 | 9/1988 | Suzuki et al. | 200/344 |
| 4,939,327 | 7/1990 | Wu et al. | 200/517 |
| 4,950,093 | 8/1990 | Ertl | 400/496 |
| 5,115,106 | 5/1992 | Weiland et al. | 200/517 |
| 5,117,076 | 5/1992 | Danitio | 200/345 X |

*Primary Examiner*—Ernest G. Cusick

*Attorney, Agent, or Firm*—Wells, St. John, Roberts, Gregory & Matkin

[57] ABSTRACT

A leveler suitable for use in multi-unit keys for a keyboard, such as a notebook keyboard, includes a J-shaped cantilever member interposed between a keycap and a base used to house the keycap. The leveler is rotatably attached to the keycap and rotatably and slidably engaged with the base. Upon actuation of the key, the slidable and rotatable portion permits the key to be compressed, while the rotatable portion attached to the keycap provides, through the action of the cantilever, a downward force upon the lower surface of the keycap. The distribution of this force via the cantilever mechanism provides a key leveling function, such that the keycap does not have a tendency to bind or stick within the guide portion of the base.

13 Claims, 17 Drawing Sheets

BEST AVAILABLE COPY

KEY LEVELER APPARATUS

RELATED PATENT DATA

This patent resulted from a continuation application of U.S. application Ser. No. 07/945,772, filed Sep. 16, 1992, now abandoned.

BACKGROUND OF THE INVENTION

This invention describes an apparatus which provides a leveling action for keys, such as those used in keyboards for notebook and other computing applications.

It is known to use levelers for keys in certain keyboard applications. In particular, levelers have been used in conjunction with multi-unit keys such as the "space bar" and "enter" keys. These keys are known as multi-unit keys because they typically occupy more space than the standard one unit alphanumeric keys such as "A" and "1" which comprise most of the keys on a keyboard of standard construction. Quite frequently, these keys occupy multiples of the footprint or area occupied by a standard key, hence the term multi-unit key. One well known problem associated with multi-unit keys is the problem of binding or sticking during actuation of the key. Typically, keys are constructed with either a single key stem, or multiple key stems attached to the back surface of the keycap and a corresponding key guide portion, or portions, which extends upwardly from a base in order to engage the key stem, as illustrated in FIG. 1. In contrast with single unit keys, multi-unit keys are capable of being actuated by forces which are not substantially aligned with the longitudinal axis of a key stem as also illustrated in FIG. 1. Such off-axis forces have a tendency to cause the key stem to be canted within the key guides such that the longitudinal axis of the key stem and key guide are no longer aligned parallel to one another. This causes the key stem to rub against the side of the key guide, thereby causing binding or sticking of the key. One solution to this problem has been to incorporate keycaps with multiple key stems and associated multiple key guides. This is not always a practical solution, however, because it has been found that the additional key stems and key guides must have a certain minimum length in order to operate effectively and prevent binding or sticking. In many cases, the minimum length required produces a key which has an overall thickness which is greater than desired for a particular keyboard application. The net effect is to increase the overall thickness of the keyboard, which is usually commercially undesirable.

In order to permit the construction of reliable, thinner keyboards, key levelers have been utilized, such as shown in FIG. 1. In a conventional multi-unit key 2, leveler 4 comprising a generally U-shaped rod 6 is utilized. Leveler 4 is rotatably attached to both ends 8 of lower surface 10 of keycap 12. As key 2 is assembled, key stems 14 are inserted into key guides 16 and leveler 4 is slidably and rotatably engaged with the base 18 which contains key guide 16. As key 2 is actuated off the longitudinal axis of key stem 14 by a force F, the portion of leveler 4 engaged in base 18 closest to the applied force F is displaced by a sliding motion within the base. This displacement also causes a similar sliding displacement of the opposing end of leveler 4 within the base and produces a downward force on the opposing end of keycap 12. The net effect is that the leveler 4 prevents canting of the keycap due to off-axis actuation forces and thereby prevents binding of the key stem 14 within key guide 16.

One problem with leveler structures of the type described above is that they require sufficient space to attach the leveler on both ends of the key and to sufficiently engage the leveler with the base. Referring again to FIG. 1, in some applications, such as notebook computer applications, the size of the elastomeric boot 19 which is commonly used as a return spring for the key, does not permit enough space to utilize a conventional leveler. In such applications, the boot dome may be located around the circumference of the key guide, rather than underneath the key guide as is often the case in keyboards of conventional construction. The diameter of the base of such elastomeric boot domes may be on the order of 0.675 inches, as opposed to a diameter on the order of 0.500 inches as is typical in conventional keyboard construction. The additional space required for the elastomeric boot dome decreases the amount of space available for additional structures under the keycap, such as a leveler. Also, the overall keycap profile, including height, width and length, in notebook keyboards may be substantially smaller than the key profile allowable in conventional keyboard construction. This further limits the amount of space available under the key to incorporate additional mechanical structures such as a leveler.

SUMMARY OF THE INVENTION

The present invention addresses the problems associated with previous leveler structures, particularly the problems associated with space constraints imposed by applications requiring low keycap profile and increased elastomeric boot dome footprint as described above.

The present invention utilizes a cantilever style leveler structure. The principal advantage of a cantilevered leveler is that the amount of space occupied under the key is minimized because the leveler only need contact the base on one end of the key as opposed to both ends of the key as is common in previous leveler structures.

Another advantage of the present invention is that a connection between the portion of the leveler which is engaged in the base, and the portion which is attached to the keycap, need only be made on one end of the key as opposed to connection via the leveler between the keycap and the base on both ends of the key as is common in previous leveler construction. This reduces the amount of material required to make a leveler, and saves on material costs.

A principal object of the present invention is to define a cantilevered leveler structure which can be incorporated using less space than levelers of typical construction, such that levelers of the present invention can be incorporated into the keyboards of notebook computers and other keyboards which do not have space available to utilize levelers of existing construction, or for use in keyboards of conventional construction where levelers of the present invention are useful or offer an advantage over levelers of the current construction.

BRIEF DESCRIPTION OF THE DRAWINGS

FIG. 4 is a partially cut-away isometric left elevation view of the key of FIG. 1 (without the partial cut-away shown in FIG. 1).

FIG. 7 is a cross-sectional view of the apparatus of FIG. 6*b* along section line BB.

FIG. 8 is a cross-sectional view of the apparatus of FIG. 6*a* along section line AA.

FIG. 9 is a cross-sectional view of the apparatus of FIG. 6*a* along section line DD.

FIG. 10 is a cross-sectional view of the apparatus of FIG. 6*a* long section line CC.

FIG. 12 is a cross-sectional view of the apparatus of 11*b* along section line BB.

FIG. 13 is a cross-sectional view of the apparatus of FIG. 11*a* along section line AA.

FIG. 14 is a cross-sectional view of the apparatus of FIG. 11*a* along section line DD.

FIG. 15 is a cross-sectional view of the apparatus of FIG. 11*a* along section line CC.

FIG. 16 is a cross-sectional view of an alternative embodiment of the present invention.

FIG. 17 is a cross-sectional view similar to that of FIG. 7 showing the alternative embodiment of the present invention.

DETAILED DESCRIPTION OF THE PREFERRED EMBODIMENT

Figure 1:
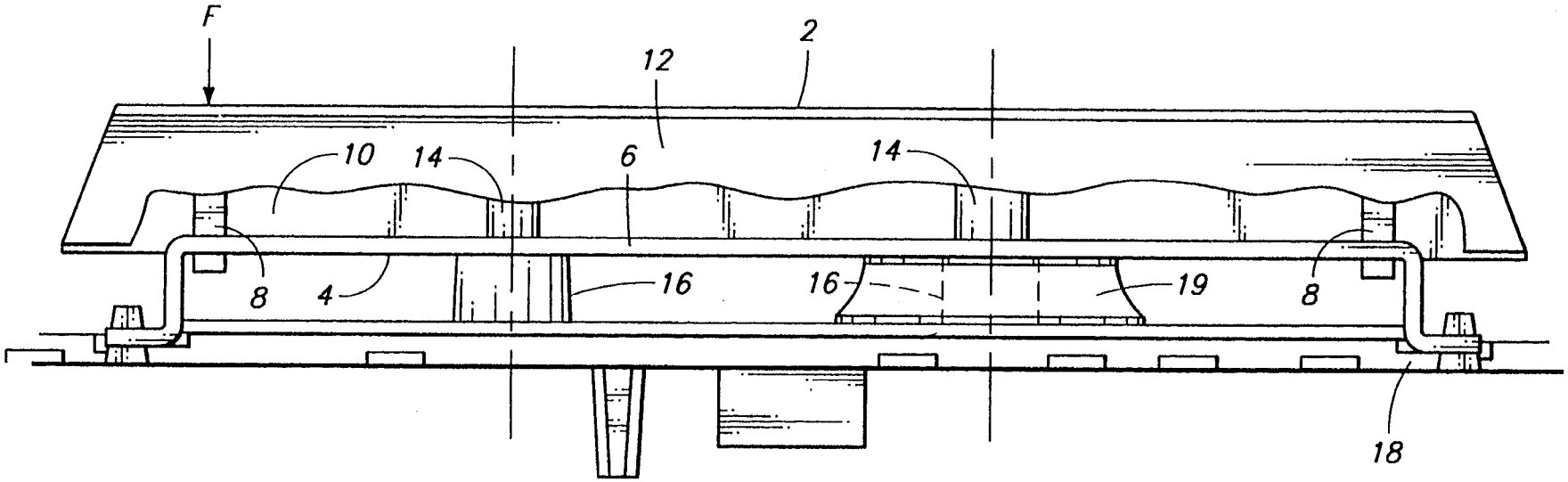
FIG. 1 PRIOR ART
FIG. 1 is a partially cut-away front elevation view of a key incorporating a related art leveling apparatus.

The apparatus of the present invention differs from related art levelers in one essential way. Levelers known in the related art have been generally U-shaped as illustrated in FIG. 1. Referring now to FIG. 1, these levelers have relied upon two points of contact with base 18 which means that levelers of this construction can slide and rotate within the base at two points. Those levelers were also attached to keycap 12 and engaged with base 18 at two points, usually at opposite ends of key 2. The apparatus of the present invention is different in that it features a cantilever type leveler construction, such that the leveler means is engaged with the base at only one point, rather than two as described herein. A cantilevered leveler offers a number of advantages over related devices which engage the base in two locations. One advantage is that less material is used in the leveler, hence material costs are lower. In addition, it offers more flexible design of an overall key structure because it does not require that the leveler be attached to the base at two locations. The combination of these advantages permits cantilevered levelers to be utilized to make keys for keyboards where space is extremely limited, such as in notebook computer applications. In fact, cantilevered levelers have been used in applications where no solution was known using levelers of the construction described in FIG. 1. A detailed description is given below of a leveling apparatus of the present invention.

Figure 2:
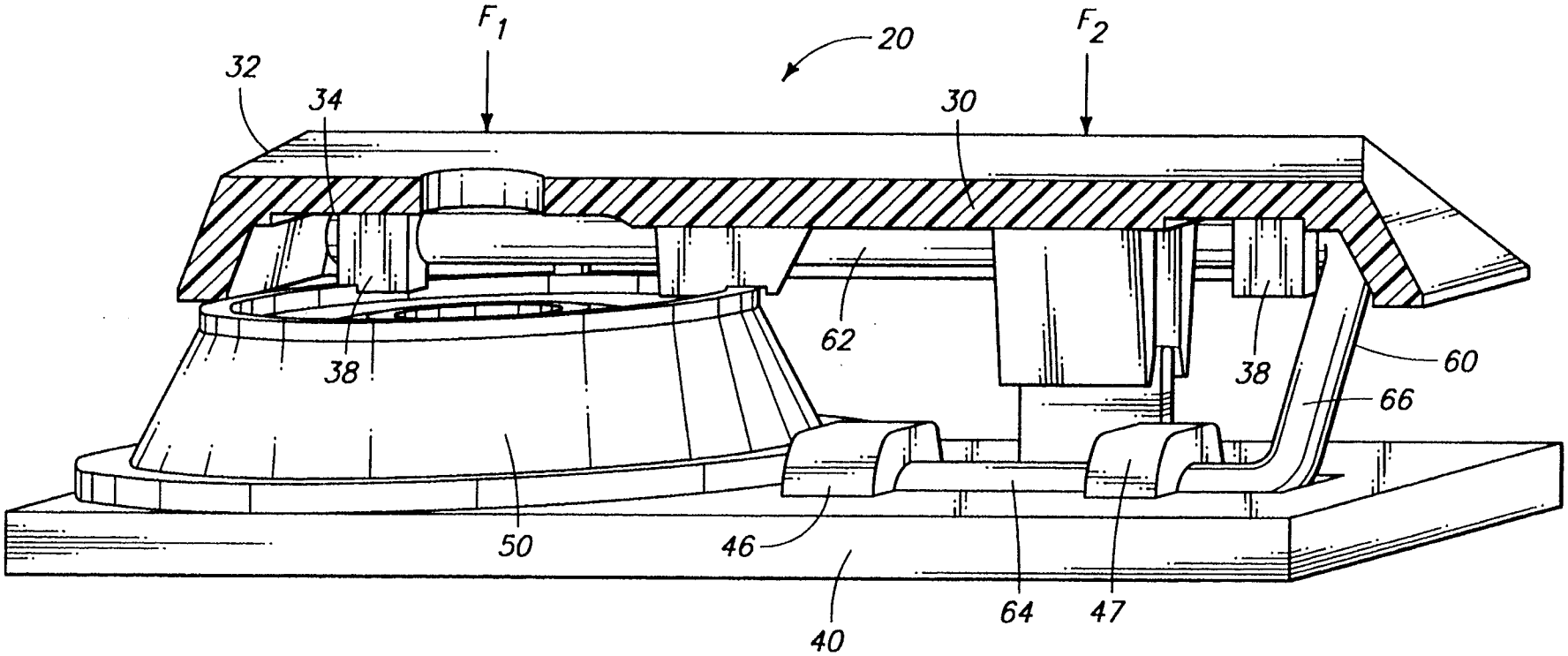
FIG. 2 is a partially cut-away perspective view of a key incorporating a preferred embodiment of a leveler of the present invention in an open or unactuated condition.
Figure 3:
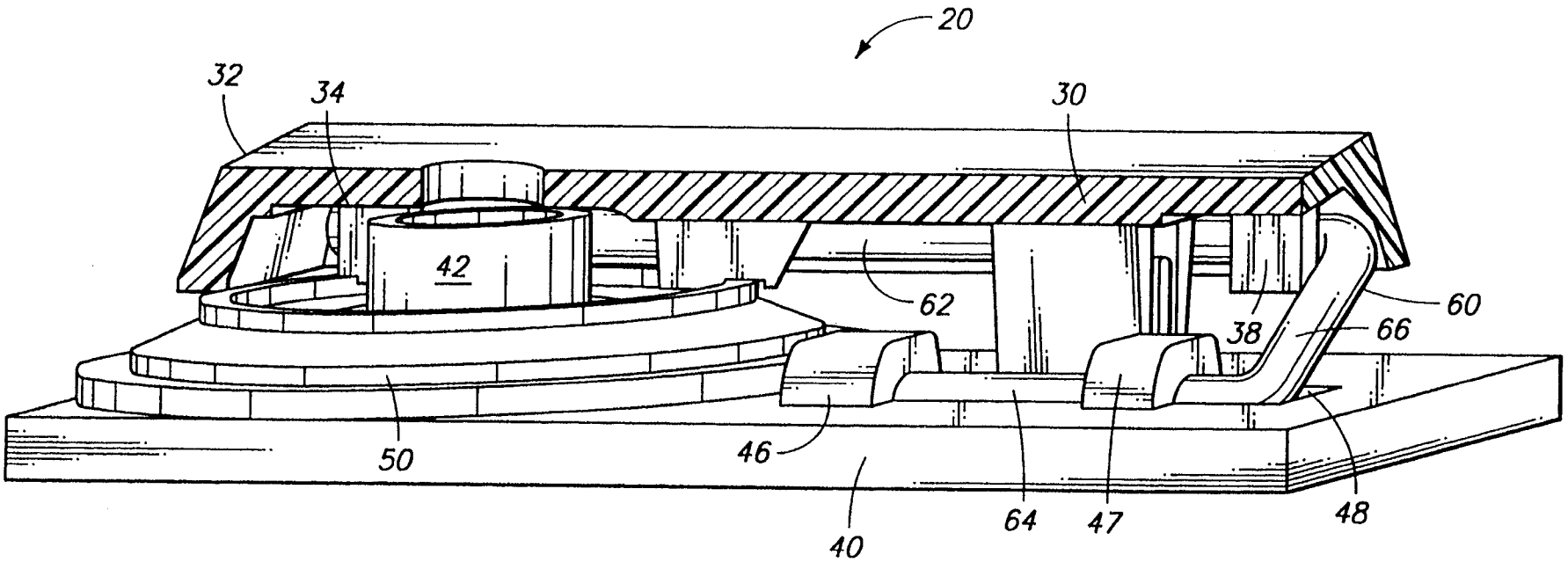
FIG. 3 is a view of the apparatus of FIG. 2 in a closed or actuated condition.
Figures 5A, 11:
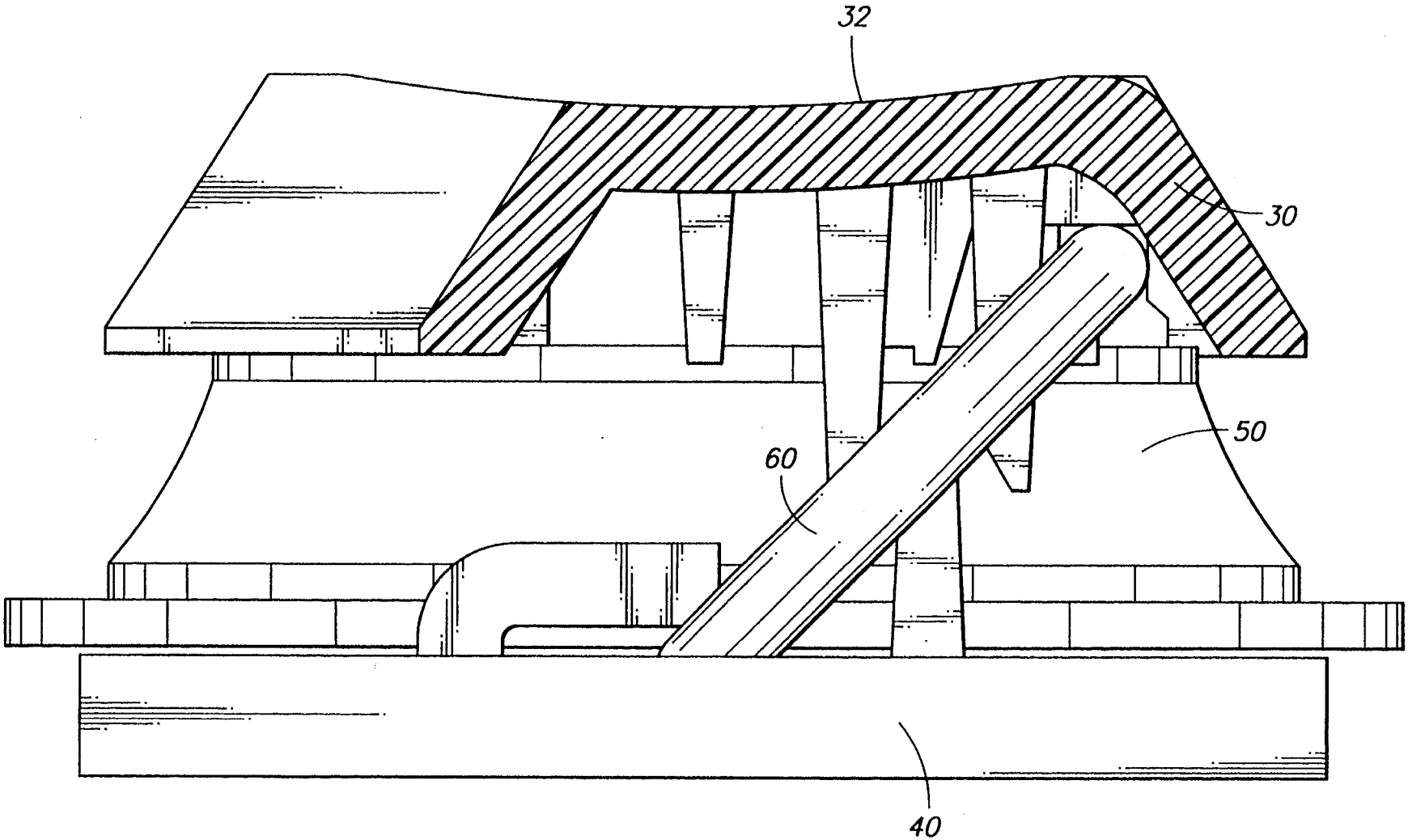
FIG. 5 is a view of the apparatus of FIG. 4 in the closed or actuated condition.
FIG. 11*a* is a plan view of a key incorporating a preferred embodiment of a leveler of the present invention in the closed or actuated condition.
FIG. 11*b* is a left elevation view of the apparatus of FIG. 11*a*.
FIG. 11*c* is a plan view of the apparatus of the apparatus of FIG. 11*a*.
Figure 11:
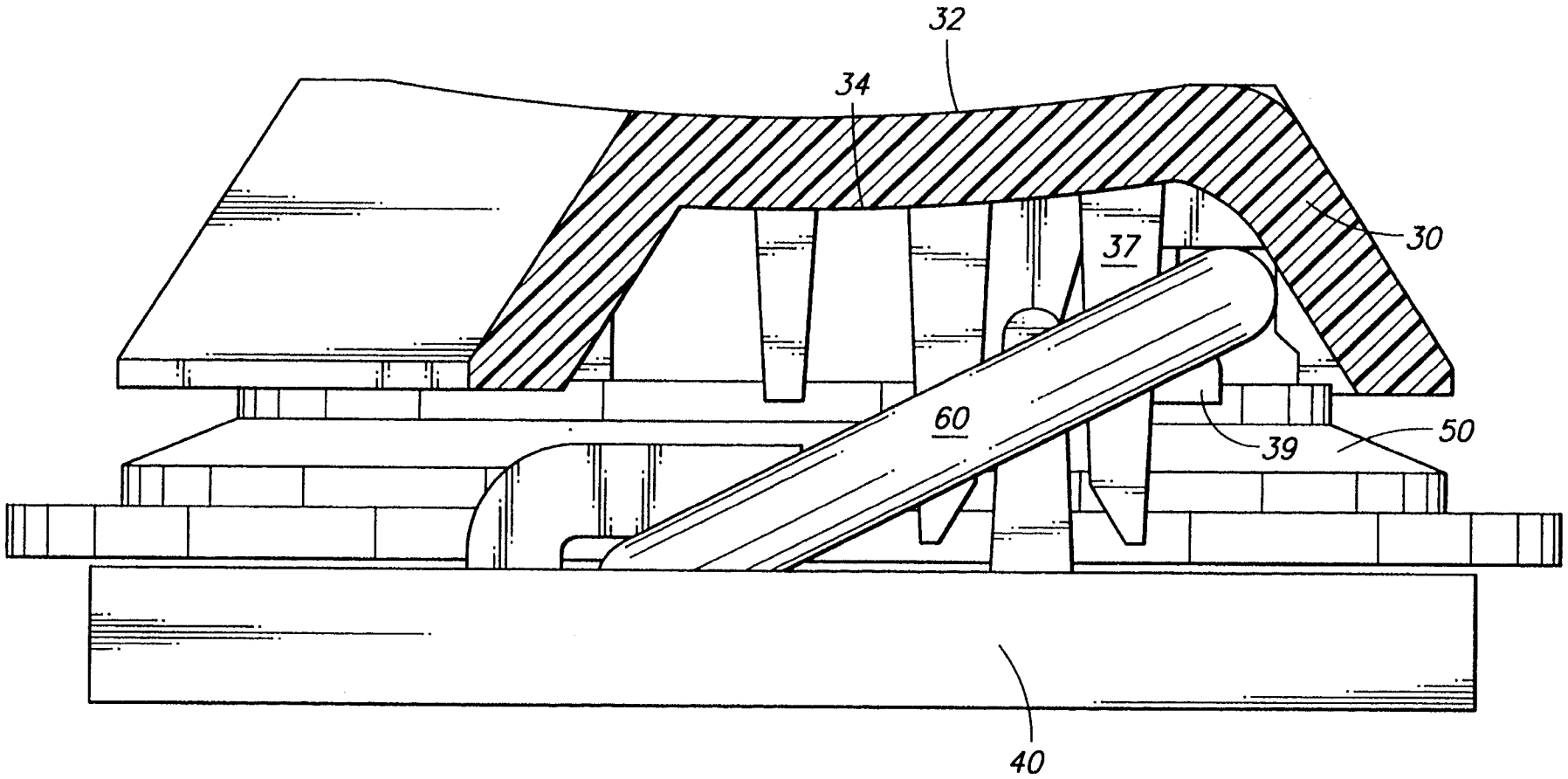

Referring now to FIGS. 2 and 7, a typical key structure incorporating a leveler of the present invention is illustrated. In a preferred embodiment, key 20 comprises keycap 30, base 40, elastomeric boot dome 50 and leveler means 60.

As also illustrated in FIGS. 2 and 7, keycap 30 comprises upper surface 32, lower surface 34, key stem 36 and attachment means 38. In a preferred embodiment, keycap 30 comprises a molded plastic shell formed from polyester or similar material which may be injection molded. The processes and materials for making keycap 30 are well known in the art. In a preferred embodiment, attachment means 38 comprises two post-like structures 37 which are molded into keycap 30, as further illustrated in FIGS. 8 and 9. Each of post-like structures 37 also incorporates a flared-end section 39.

Referring now to FIGS. 2, 7 and 9, leveler means 60 includes an upper member 62, lower member 64 and a connecting member 66. In a preferred embodiment, leveler means 60 is generally J-shaped, with upper member 62 being longer than lower member 64.

Referring again to FIGS. 2, 3, 7, 8, 9 and 10, base 40 comprises a key guide 42 and engagement means 44 for leveler means 60. In a preferred embodiment, engagement means 44 comprises inner retention arm 46, outer retention arm 47 and recess 48. It is known, however, that both inner and outer retention arms are not essential for the function of the apparatus. For instance, key 20 can be operated without excessive binding or sticking of key stem 36 within key guide 42 without inner retention arm 46. Other single retention arm arrangements may be possible. Having a plurality of retention arms may merely serve to somewhat enhance the function and reliability of leveler mean 60, but a single retention arm, such as outer retention arm 47 is sufficient to allow the device to function for the purposes described herein. Also, in a preferred embodiment, base 40 comprises a single injection molded polyester sheet made from materials and processes well known in the art. Key guide 42 and engagement means 44 are molded into base 40 as part of the injection molding process used to produce base 40.

Elastomeric boot dome 50 is of type well known in the art such as described in U.S. Pat. No. 5,115,106 to Weiland, et al.

Also, in a preferred embodiment, leveler means 60 is formed into the J-shape from steel rod or wire and subsequently plated with a metal finish of a type well known in the art, such as chrome or nickel, to provide a smooth surface finish and corrosion protection, in order to enhance the reliability of leveler means 60 in a variety of different environments.

A plurality of keys, including a key or keys 20 incorporating leveler means 60, can be combined to form a keyboard, such as a notebook computer keyboard. In such an embodiment, a plurality of bases 40 are combined into a unitary sheet which is commonly known as a housing sheet or by similar terms of art. A housing sheet would comprise a plurality of key guides 42 and engagement means 44. In such applications, a plurality of elastomeric boot domes 50 corresponding to key guides 42 are also commonly combined into a unitary sheet which is known as a term of art as a boot sheet.

Referring now to FIGS. 2, 3, 4, 5, 8, 9 and 10, the structure and workings of a preferred embodiment of the present invention are further described. In the assembly of key 20, leveler means 60 is attached to keycap 30 by the insertion of upper member 62 into the space formed between flared-end sections 39 of post-like structures 37 and lower surface 34 of keycap 30. Upper member 62 is essentially snapped into place and held in attachment to keycap 30 by the geometry of post-like structures 37 and flared-end sections 39. In this state of assembly, upper member 62 can be rotated freely within keycap 30 around a longitudinal axis 63. As an additional part of the assembly process, keycap 30 with leveler means 60 attached is engaged with the combination of elastomeric boot dome 50 and base 40. As illustrated in FIGS. 2, 8, 9 and 10, key stem 36 of keycap 30 is engaged with key guide 42 of base 40 and leveler mean 60 is engaged in engagement means 44 by the insertion of lower member 64 into recess 48 under inner retention arm 46 and outer retention arm 47. Lower member 64 is engaged with base 40 by being positioned in recess 48 and under the outer portions of inner retention arm 46 and outer retention arm 47 away from where these arms attach to base 40. As shown in FIG. 7, key stem 36 is retained within key guide 42 by flared section 35 while being biased upwardly by the action of elastomeric boot dome 50. Thus assembled, key 20 is available for operation or actuation as further described below.

Figure 6C:
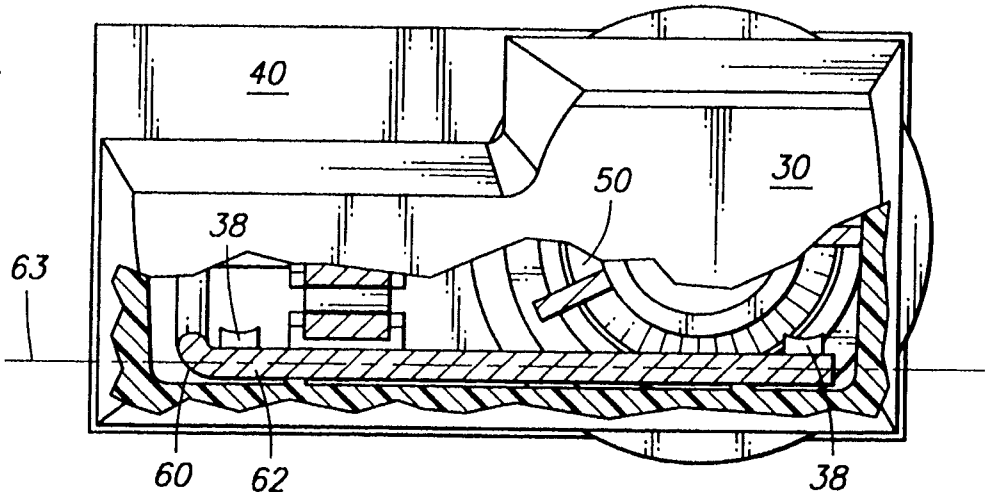
FIG. 6*c* is a plan view of the apparatus of FIG. 6*a*.
Figure 6A:
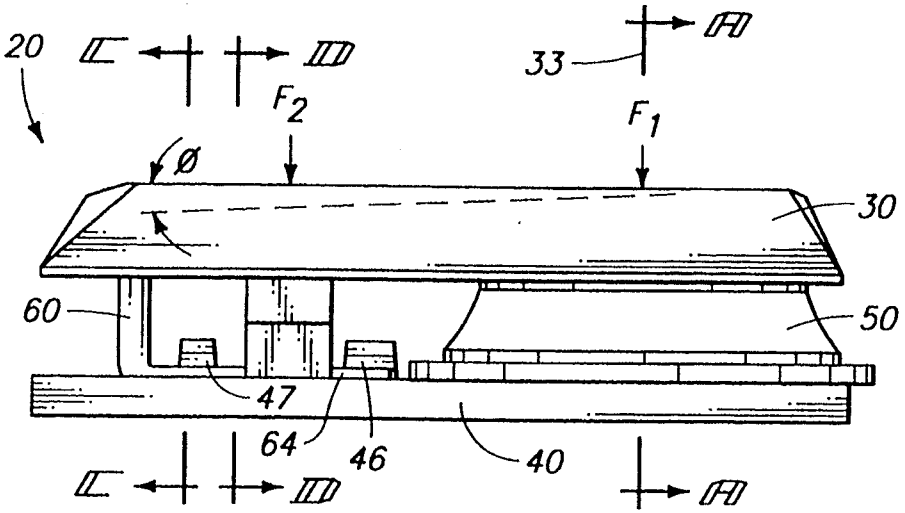
FIG. 6*a* is a front elevation view of a key incorporating a preferred embodiment of a leveler of the present invention in the open or unactuated condition.
Figure 6B:
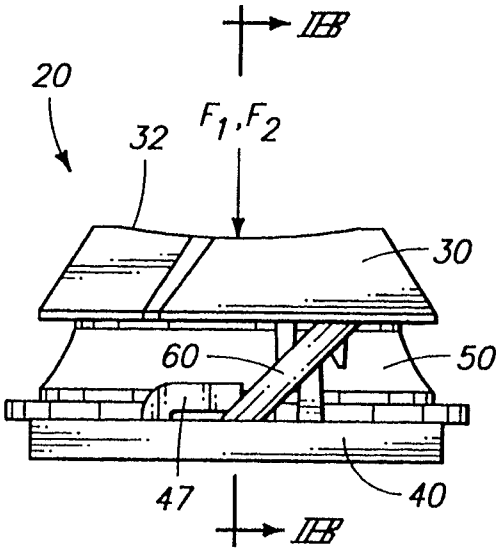
FIG. 6*b* is a left elevation view of the apparatus of FIG. 6*a*.
Figure 11:
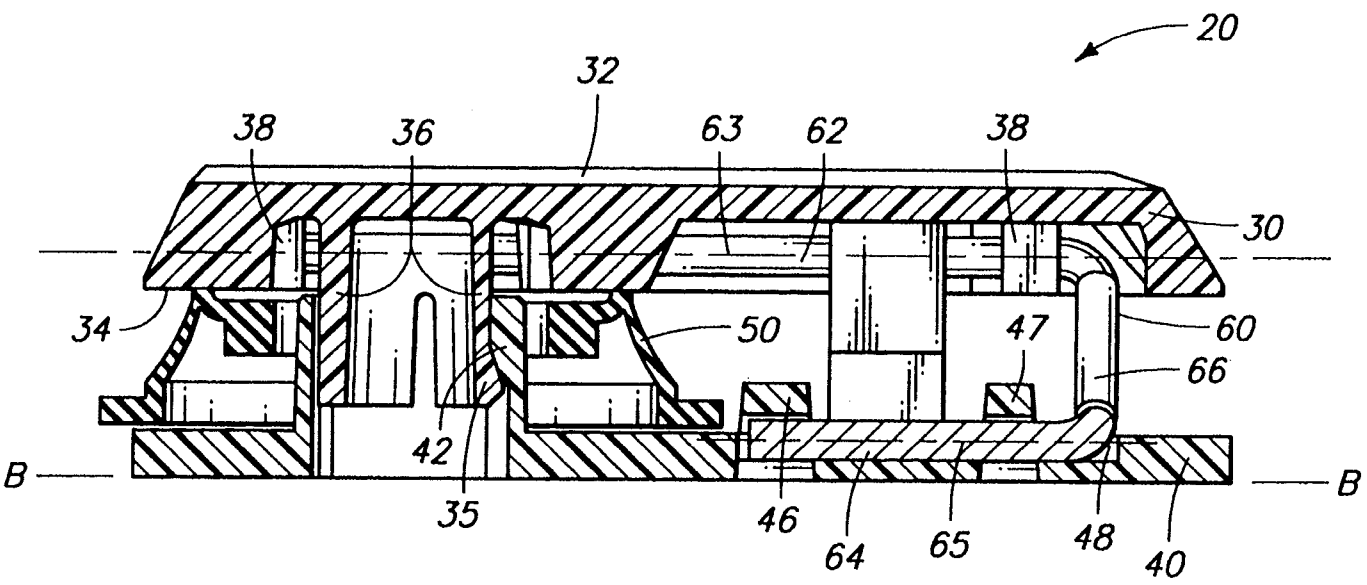
Figure 11B:
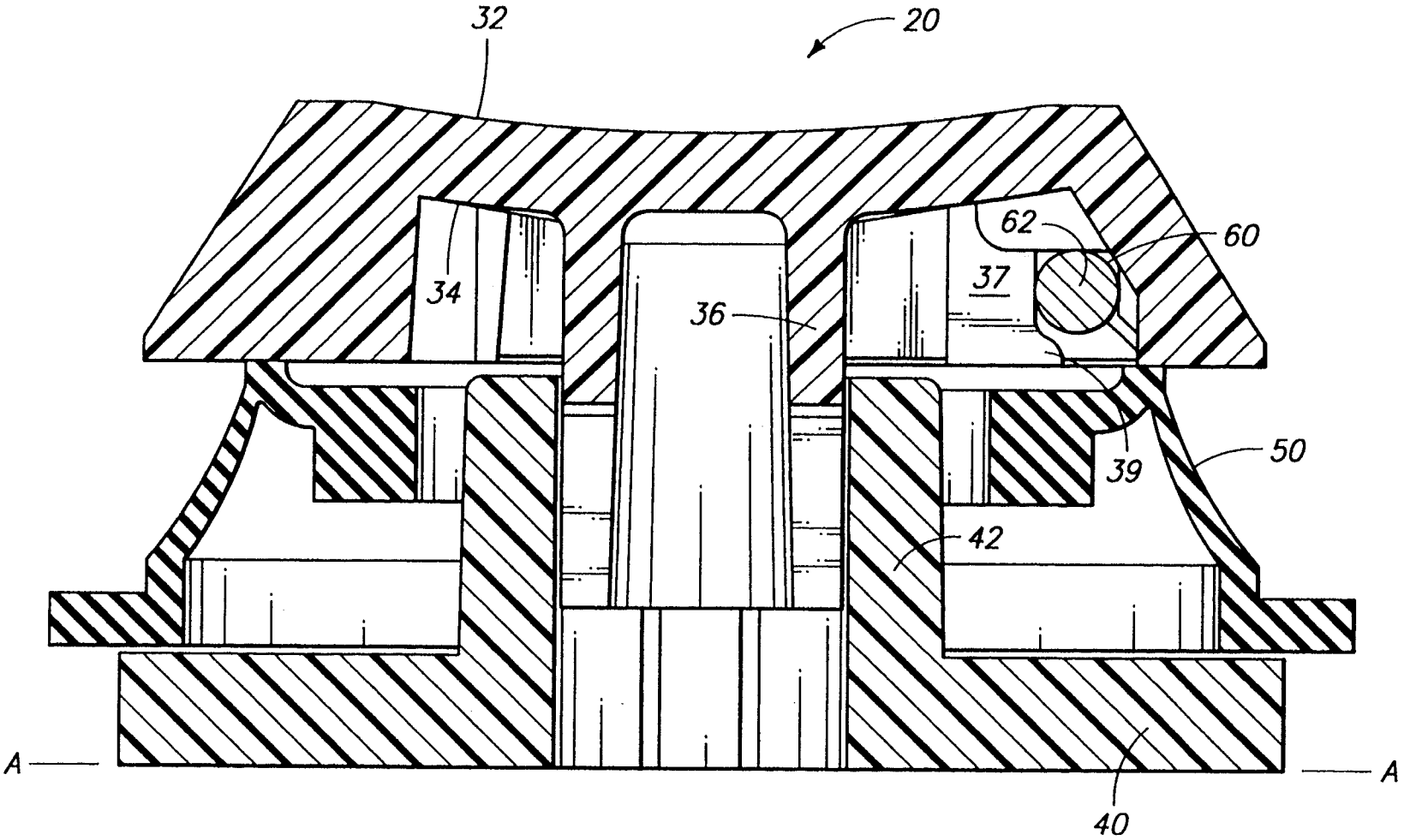
Figure 11:
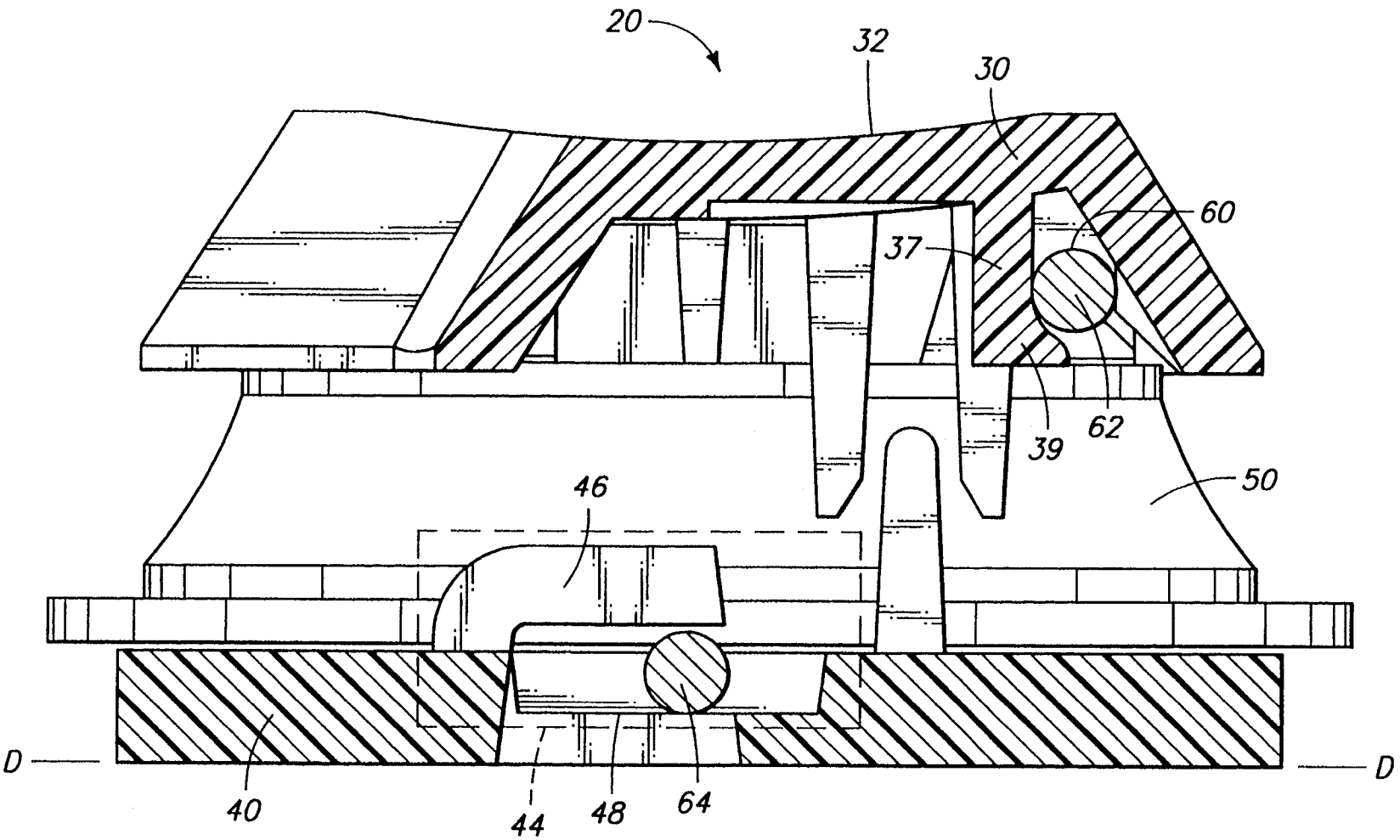
Figure 11:
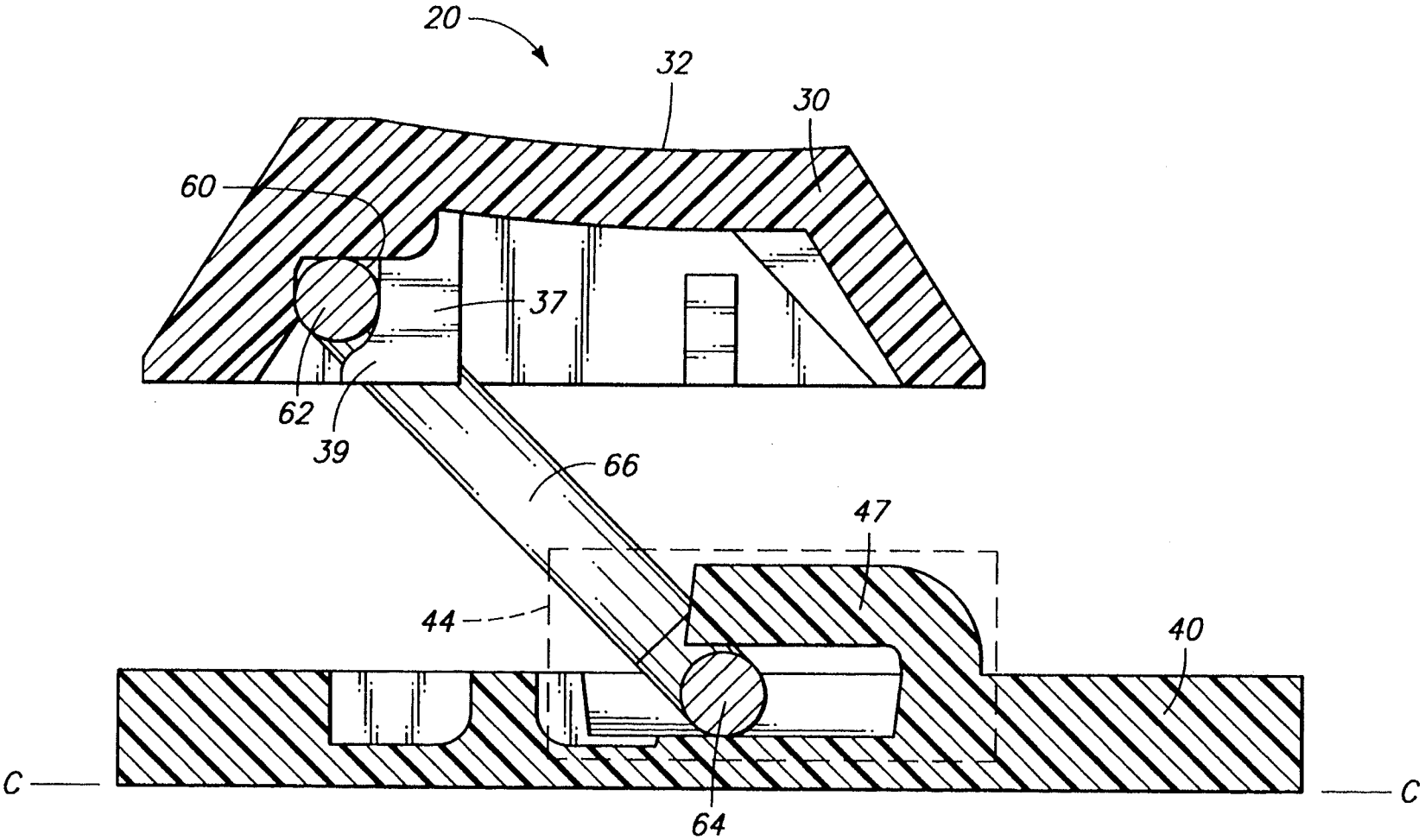
Figure 11C:
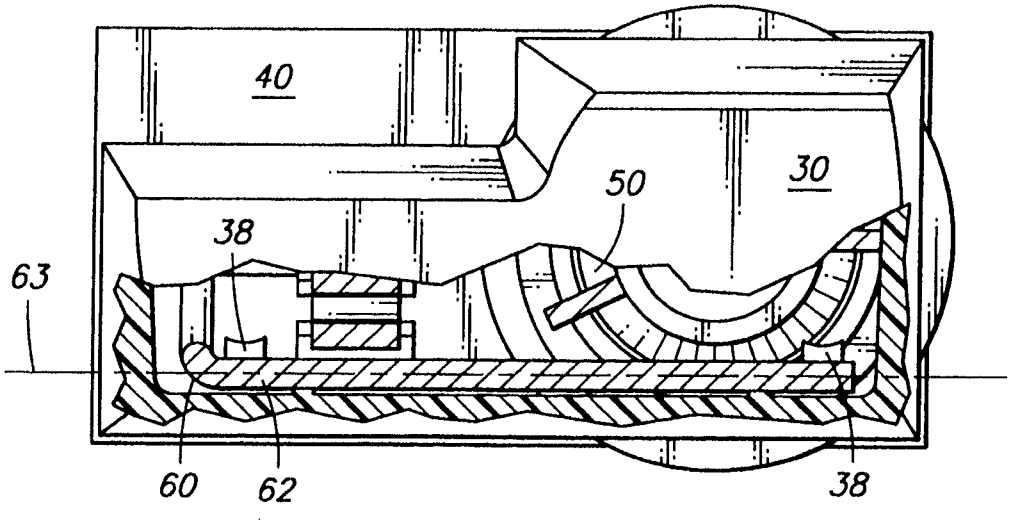
Figure 11A:
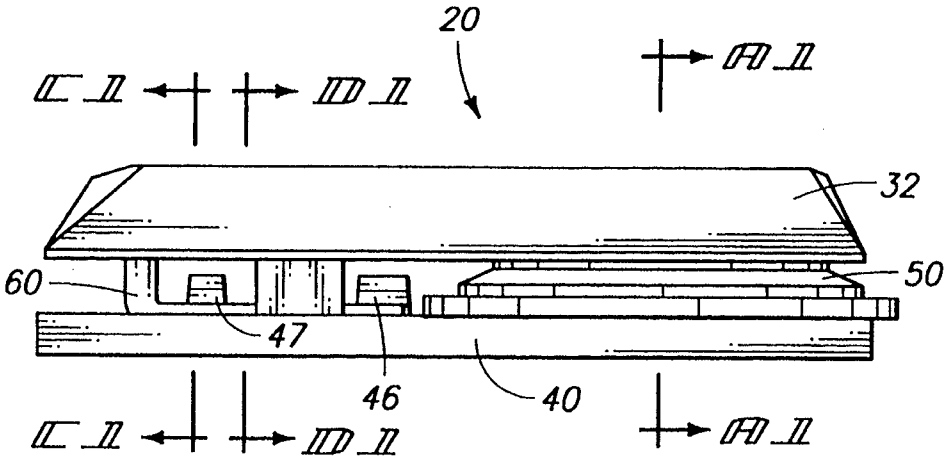
Figure 11B:
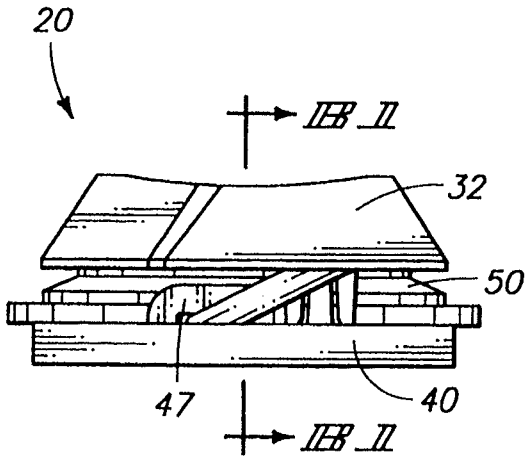
Figure 11:
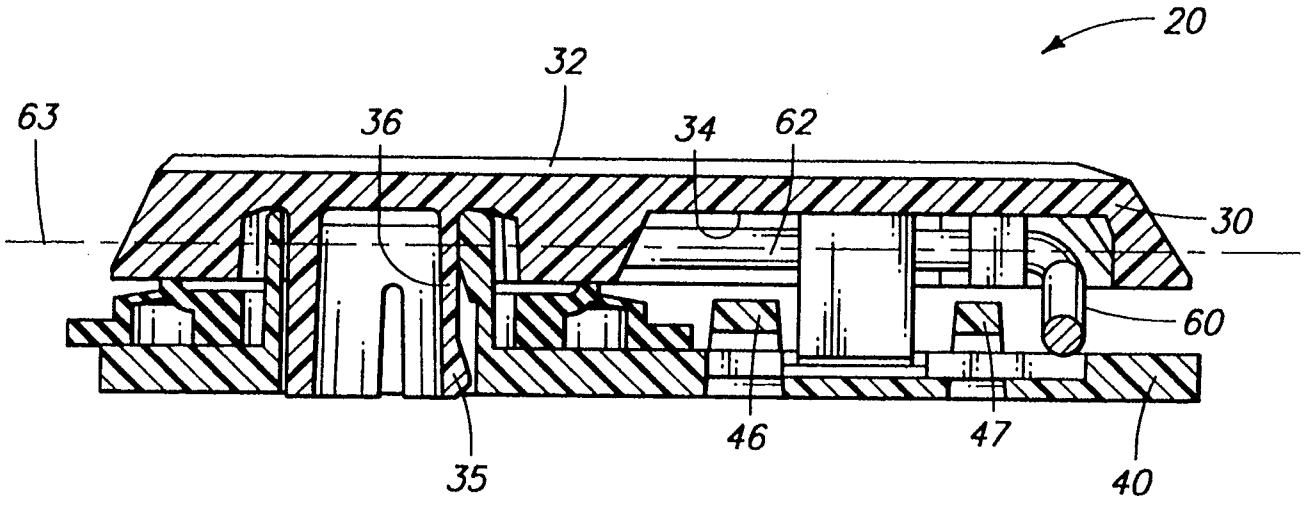
Figure 11:
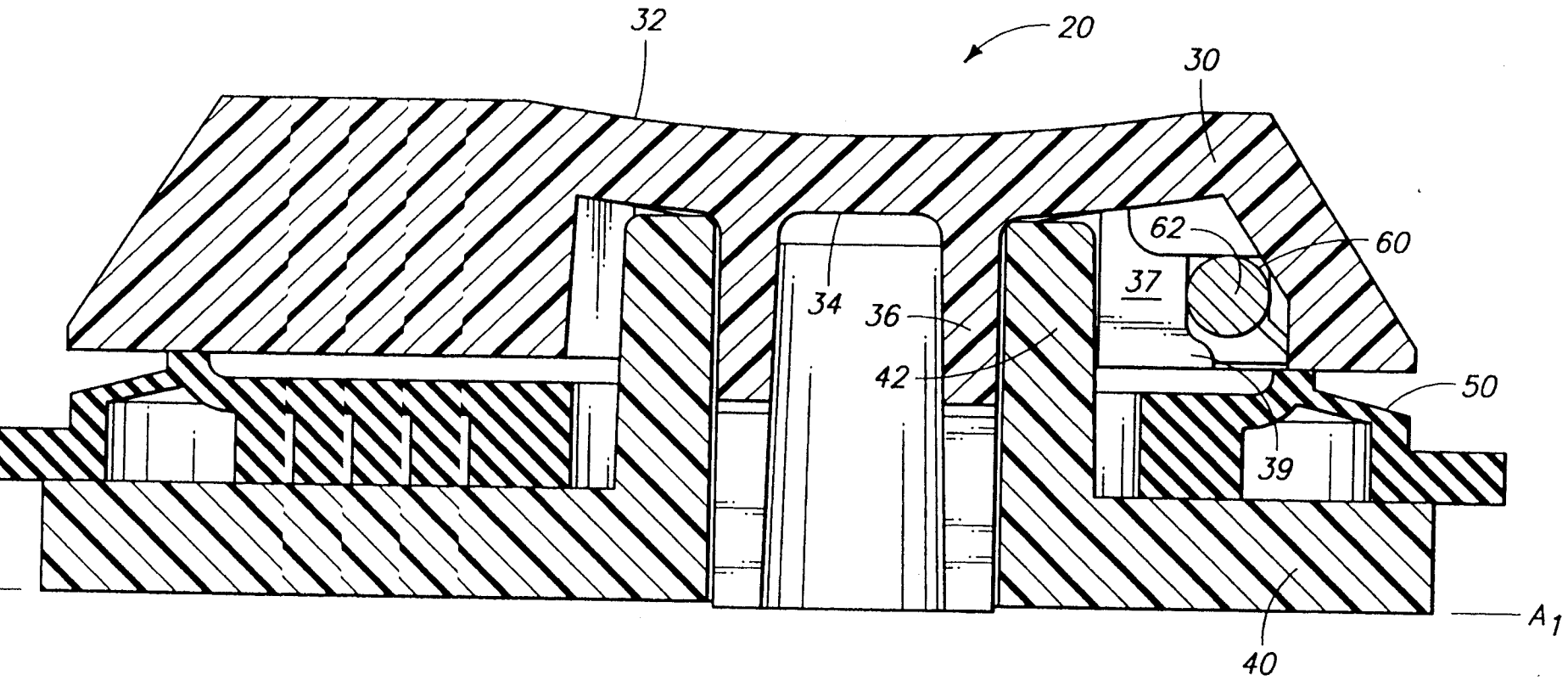
Figure 11:
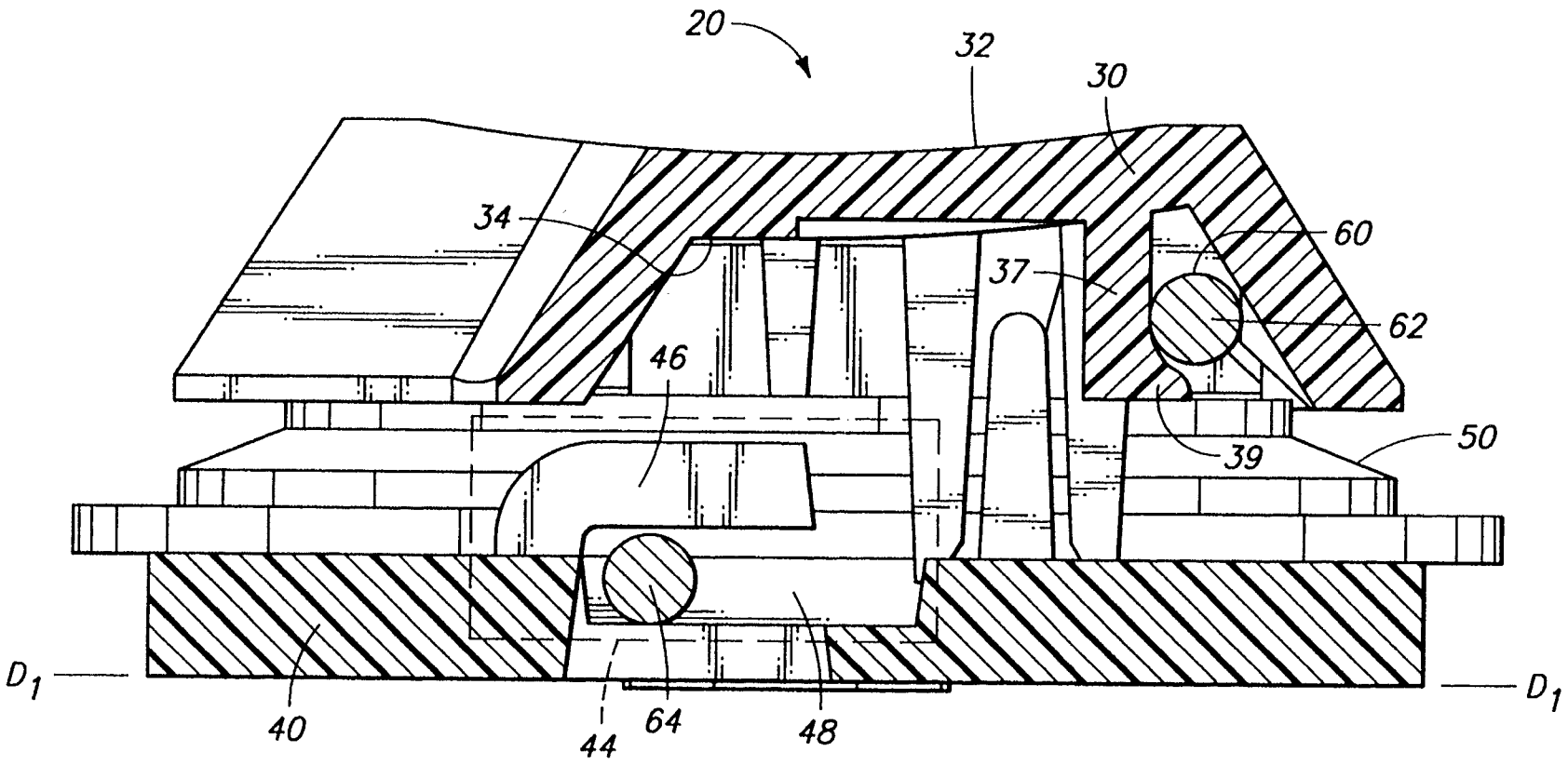
Figure 11:
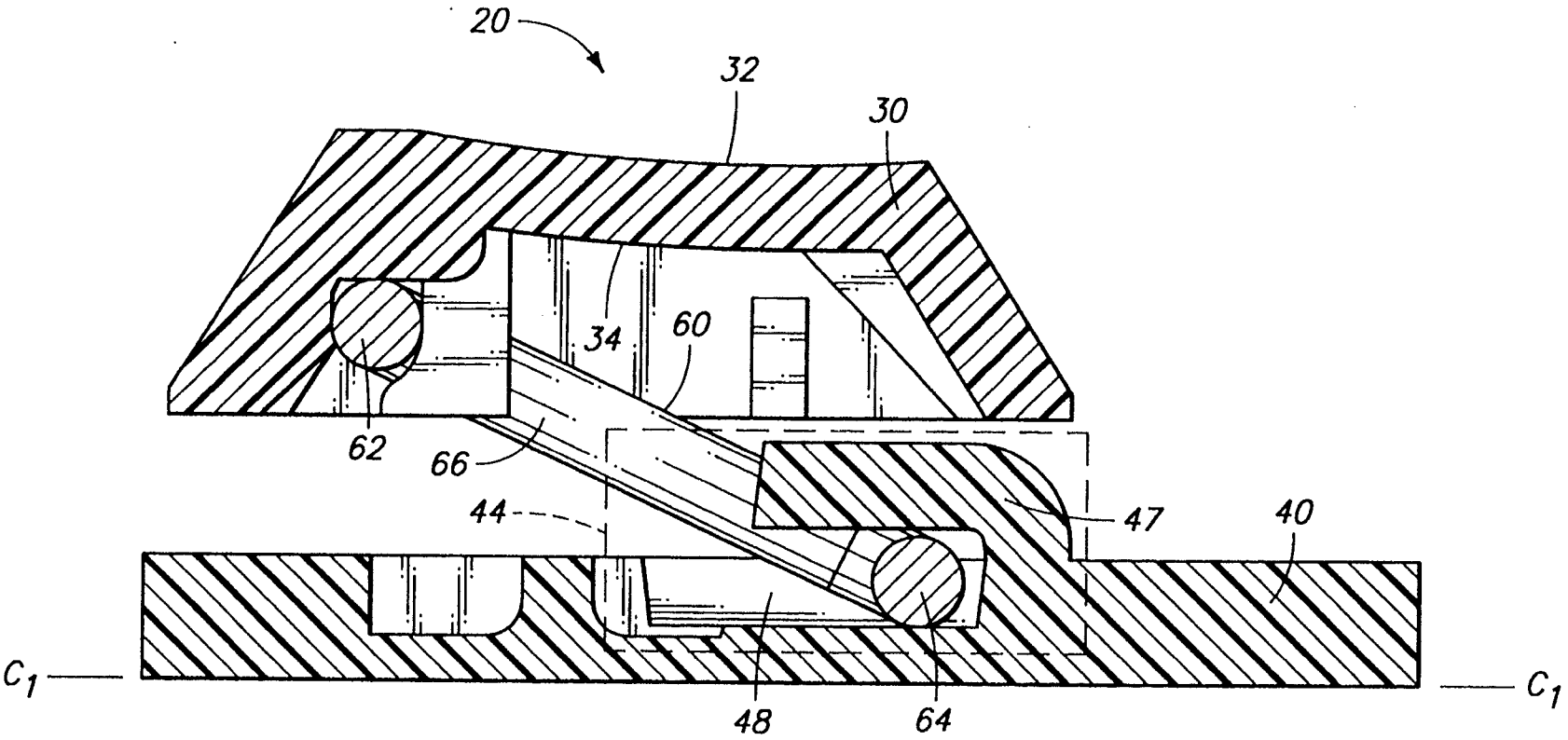
Figure 11:
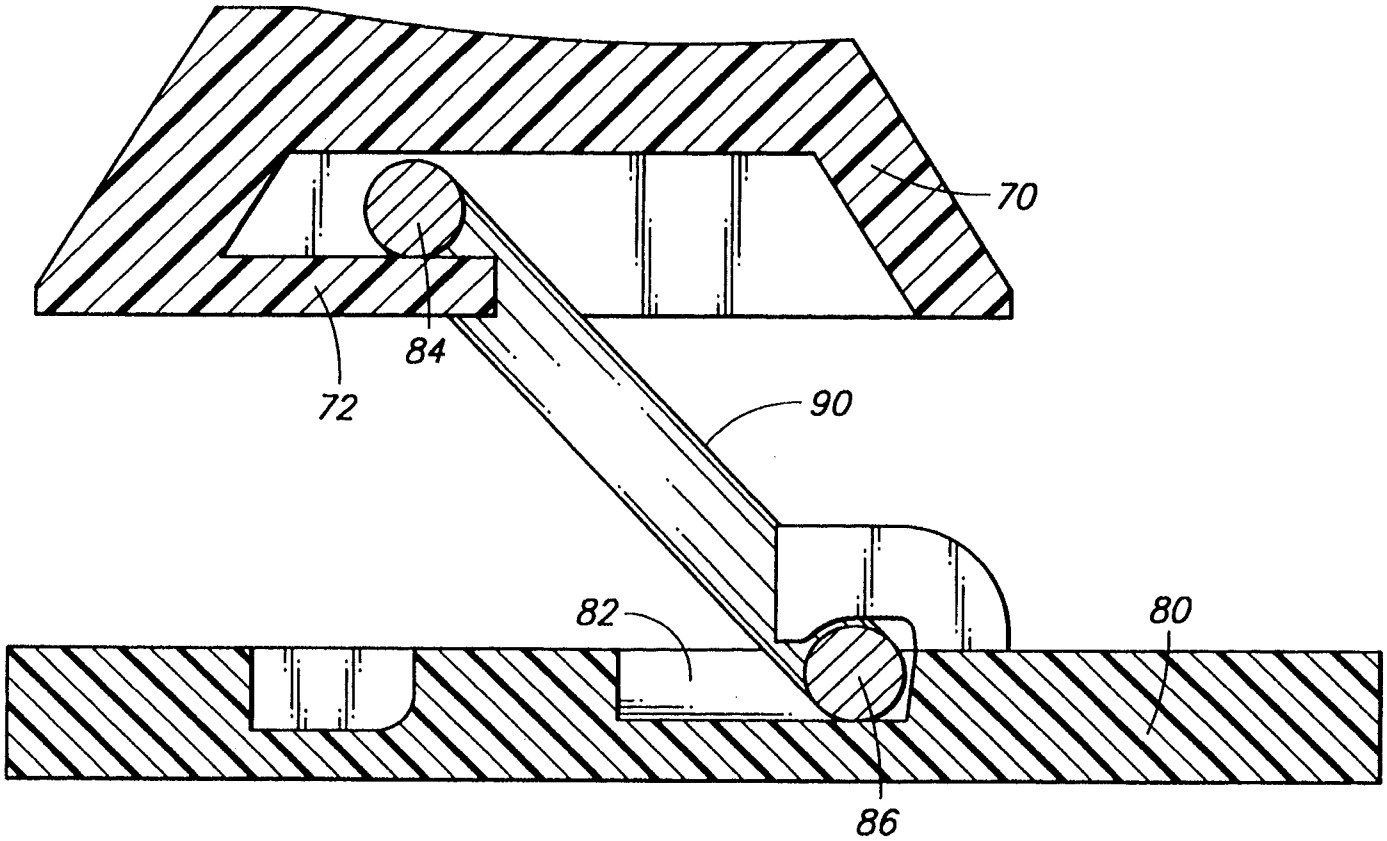
Figure 11:
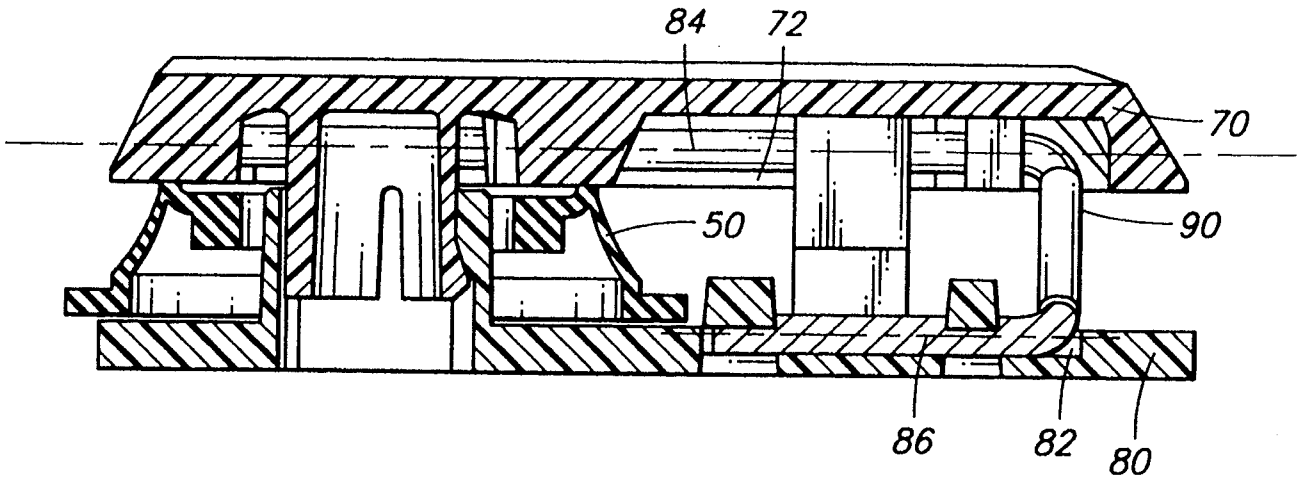

Referring now to FIGS. 2, 4, 6*a*, 6*b*, 6*c*, 7, 8, 9, and 10, key 20 is shown in its open or unactuated position. Upon application of an actuation force $F_1$ along longitudinal axis 33 of key stem 36 as shown in FIGS. 2 and 6*a*, such as by finger actuation, key 20 and specifically leveler means 60 moves to the position described below.

Referring now to FIGS. 3, 5, 11*a*, 11*b*, 12, 13, 14, and 15, key 20 is illustrated in the actuated or closed position. Key 20 moves to this position in response to application of force $F_1$ as illustrated in FIG. 2. As force $F_1$ is applied to key 20 in the open position, it overcomes the upward bias applied by the reaction of elastomeric boot dome 50, and keycap 30 begins to move downwardly toward base 40. Key stem 36 moves downwardly within key guide 42 and keycap 30 compresses elastomeric boot dome 50. As keycap 30 moves downwardly, upper member 62 rotates around longitudinal axis 63 while maintaining its attachment to keycap 30 through the action of post structures 37 and flared-end sections 39. At the same time, lower member 64 slides within recess 48 under inner retention arm 46 and outer retention arm 47 toward the point at which they are attached to base 40. Lower member 64 slides nearly perpendicular to longitudinal axis 65. As lower member 64 slides under inner retention arm 46 and outer retention arm 47, it also rotates around longitudinal axis 65. FIGS. 3, 5, 11*a*, 11*b*, 12, 13, 14, and 15 represent illustrations of key 20 once it has been actuated or closed.

Upon actuation of key 20, the sliding and rotating movement of lower member 64 portion permits key 20 to be compressed, while the rotating movement of upper member 62 which is attached to the keycap 30 provides, through cantilever action, a distributed downward force upon the lower surface 34 of keycap 30.

Referring now to FIGS. 2 and 6*a*, in the event that the applied force for key closure is not applied along longitudinal axis 33 or in a region proximate to longitudinal axis 33, such as is illustrated by force $F_2$, the particular benefits of leveler means 60 can be illustrated. If an off axis force $F_2$ is utilized to actuate key 20, leveler means 60 operates as described above. Without the use of leveler means 60, application of force $F_2$ would tend to cause the end of key 20 proximate to the region where force $F_2$ is applied to cant downwardly and cause key stem 36 to bind or stick within key guide 42.

The action of leveler means 60 prevents such action from occurring. When force $F_2$ is applied, the end of upper member 62 closest to the region where force $F_2$ is applied begins to be displaced downwardly. The opposite end of upper member 62 is also displaced downwardly. When the end of upper member 62 at which force $F_2$ is applied begins to be displaced downwardly, leveler means 60 begins to exert a downward force on keycap 30 at the end opposite that at which force $F_2$ is applied, through the cantilever action of leveler means 60, even though the opposing ends of upper member 62 may be displaced at slightly different rates or absolute values of displacement. Such downward force also causes the end of keycap 30 opposite the end at which force $F_2$ is applied to be displaced downwardly in conjunction with the end of keycap 30 which is proximate to the region where force $F_2$ is applied. The net effect is that the amount of cant permitted in the keycap represented in FIG. 6*a* by the angle $\phi$ is controlled such that key stem 36 does not become misaligned within key guide 42 and hence have a tendency to bind or stick within key guide 42. The angle $\phi$ can be controlled through the appropriate tolerancing of the various components of key 20, including leveler means 60, so as to prevent the binding or sticking of key stem 36 within key guide 42 upon application of an actuation force. Typically keycap 30, base 40, elastomeric boot dome 50 and leveler means 60 are appropriately shaped and toleranced such that an actuation force can be applied anywhere along upper surface 32 of keycap 30, as shown in FIGS. 2 and 6*a*, without causing binding or sticking as described above. The sizing and tolerancing of these various components with respect to one another depends on the size and overall geometry of keycap 30, and must take into consideration the amount of space available for leveler means 60 and elastomeric boot dome 50, and their relative positions with respect to one another.

It is also thought that leveler means of the present invention could be incorporated in certain circumstances such that the action of the leveler as described above is essentially reversed. FIGS. 16 and 17 represent such an embodiment, comprising a keycap 70, base 80 and leveler means 90. Keycap 70 comprises an engagement means 72 for leveler means 90. Base 80 comprises an attachment means 82 for attaching leveler means 90. The action of such a leveling means would be similar to that described above, except that leveler means 90 would rotate, around a first longitudinal axis 84, within attachment means 82, and leveler means 90 would slide and rotation, around a second longitudinal axis 86, within engagement means 72.

We claim:

1. A key leveling apparatus for use in a computer key having a keycap, the keycap being movable between an extended position and a depressed position, comprising:

a J-shaped leveler adapted for providing cantilever support to a keycap, the J-shaped leveler having an upper member, a lower member, and a connecting member joining the upper and lower members, the lower member having a length;

upper means adapted for rotatably attaching the upper member of the leveler to a keycap;

lower means adapted for rotatably attaching the lower member of the leveler to a base; and the length of the lower member of the J-shaped leveler as operably attached to the lower means being effective to produce a cant-resisting cantilever action that maintains the keycap substantially level as the keycap is depressed.

2. A key leveling apparatus according to claim 1 wherein the upper member of the J-shaped leveler has a length greater than the length of the lower member of the J-shaped leveler.

3. A key leveling apparatus according to claim 1 wherein: the upper member of the J-shaped leveler has a length; and the length of the lower member of the J-shaped leveler is in a range of one-third to one-half of the length of the upper member.

4. A key leveling apparatus according to claim 1 wherein:

the upper member of the J-shaped leveler has a length; and the length of the lower member of the J-shaped leveler is approximately one-half of the length of the upper member.

5. A key leveling apparatus according to claim 1 wherein the lower means is configured for slidably and rotatably attaching the lower member of the leveler to the base, the lower member being free to rotate within the lower means about a longitudinal axis and to slide within the lower means approximately perpendicular to the longitudinal axis.

6. A key leveling apparatus according to claim 1 wherein the upper means is configured for slidably and rotatably attaching the upper member of the leveler to the keycap, the upper member being free to rotate within the upper means about a longitudinal axis and to slide within the upper means approximately perpendicular to the longitudinal axis.

7. A key leveling apparatus according to claim 1 wherein the J-shaped leveler comprises a single, integral rod.

8. A computer key, comprising:

a base;

a keycap movable between an extended position and a depressed position, the keycap having a center and first and second ends offset from the center;

an elastomeric dome positioned between the keycap and the base and aligned beneath the first end of the keycap;

a J-shaped leveler for providing cantilever support to the keycap, the J-shaped leveler having an upper member rotatably coupled to the keycap, a lower member rotatably coupled to the base, and a connecting member joining the upper and lower members; and the lower member of the J-shaped leveler being coupled to the base beneath the second end of the keycap and having a length that is effective to produce a cant-resisting cantilever action to maintain the keycap substantially level as the keycap is depressed.

9. A computer key according to claim 8 wherein the upper member of the J-shaped leveler extends across the keycap from the first end to the second end.

10. A computer key according to claim 8 wherein:

the upper member of the J-shaped leveler has a length; and the length of the lower member of the J-shaped leveler is in a range of one-third to one-half of the length of the upper member.

11. A computer key according to claim 8 wherein:

the upper member of the J-shaped leveler has a length; and the length of the lower member of the J-shaped leveler is approximately one-half of the length of the upper member.

12. A computer key according to claim 8 wherein the J-shaped leveler comprises a single, integral rod.

13. A J-shaped leveler for maintaining a keycap of a computer key substantially level relative to a base as the keycap is depressed, the J-shaped leveler comprising a single, integral rod consisting of an upper member adapted for connection to the keycap, a lower member adapted for connection to the base, and a connecting member joining the upper and lower members.

* * * * *